US006096191A

United States Patent [19]

Kalnes

[11] Patent Number: 6,096,191

[45] Date of Patent: Aug. 1, 2000

[54] PROCESS FOR HYDROCRACKING A HYDROCARBONACEOUS FEEDSTOCK

[75] Inventor: Tom N. Kalnes, La Grange, Ill.

[73] Assignee: UOP LLC, Des Plaines, Ill.

[21] Appl. No.: 09/181,246

[22] Filed: Oct. 28, 1998

[51] Int. Cl.[7] ..... C10G 9/00; C10G 47/02; C10G 47/12

[52] U.S. Cl. ..... 208/105; 208/100; 208/103; 208/108; 208/109

[58] Field of Search ..... 208/100, 103, 208/105, 108, 109

[56] References Cited

U.S. PATENT DOCUMENTS

| | | | |
|---|---|---|---|
| 3,546,099 | 12/1970 | Sutherland | 208/102 |
| 3,574,090 | 4/1971 | Hallman | 208/108 |
| 4,931,165 | 6/1990 | Kalnes | 208/100 |
| 5,141,630 | 8/1992 | Grosboll et al. | 208/356 |
| 5,164,070 | 11/1992 | Munro | 208/60 |

*Primary Examiner*—Walter D. Griffin
*Assistant Examiner*—Tam M. Nguyen
*Attorney, Agent, or Firm*—John G. Tolomei; John G. Cutts, Jr.

[57] ABSTRACT

A catalytic hydrocracking process wherein a hydrocarbonaceous feedstock and a liquid recycle stream having a temperature greater than about 500° F. and saturated with hydrogen is contacted with hydrogen and a metal promoted hydrocracking catalyst in a hydrocracking reaction zone at elevated temperature and pressure to obtain conversion to lower boiling hydrocarbons. The resulting hot, uncooled effluent from the hydrocracking reaction zone is hydrogen stripped in a stripping zone maintained at essentially the same pressure as the hydrocracking zone to produce a first gaseous hydrocarbonaceous stream and a first liquid hydrocarbonaceous stream. At least a portion of the first gaseous hydrocarbonaceous stream is condensed to produce a second liquid hydrocarbonaceous stream and a second hydrogen-rich gaseous stream. At least a portion of the first liquid hydrocarbonaceous stream is recycled to the hydrocracking reaction zone. At least a portion of the second hydrogen-rich gaseous stream supplies hydrogen to the hydrocracking reaction zone and to the stripping zone. At least a portion of the second liquid hydrocarbonaceous stream is recovered as product.

17 Claims, 1 Drawing Sheet

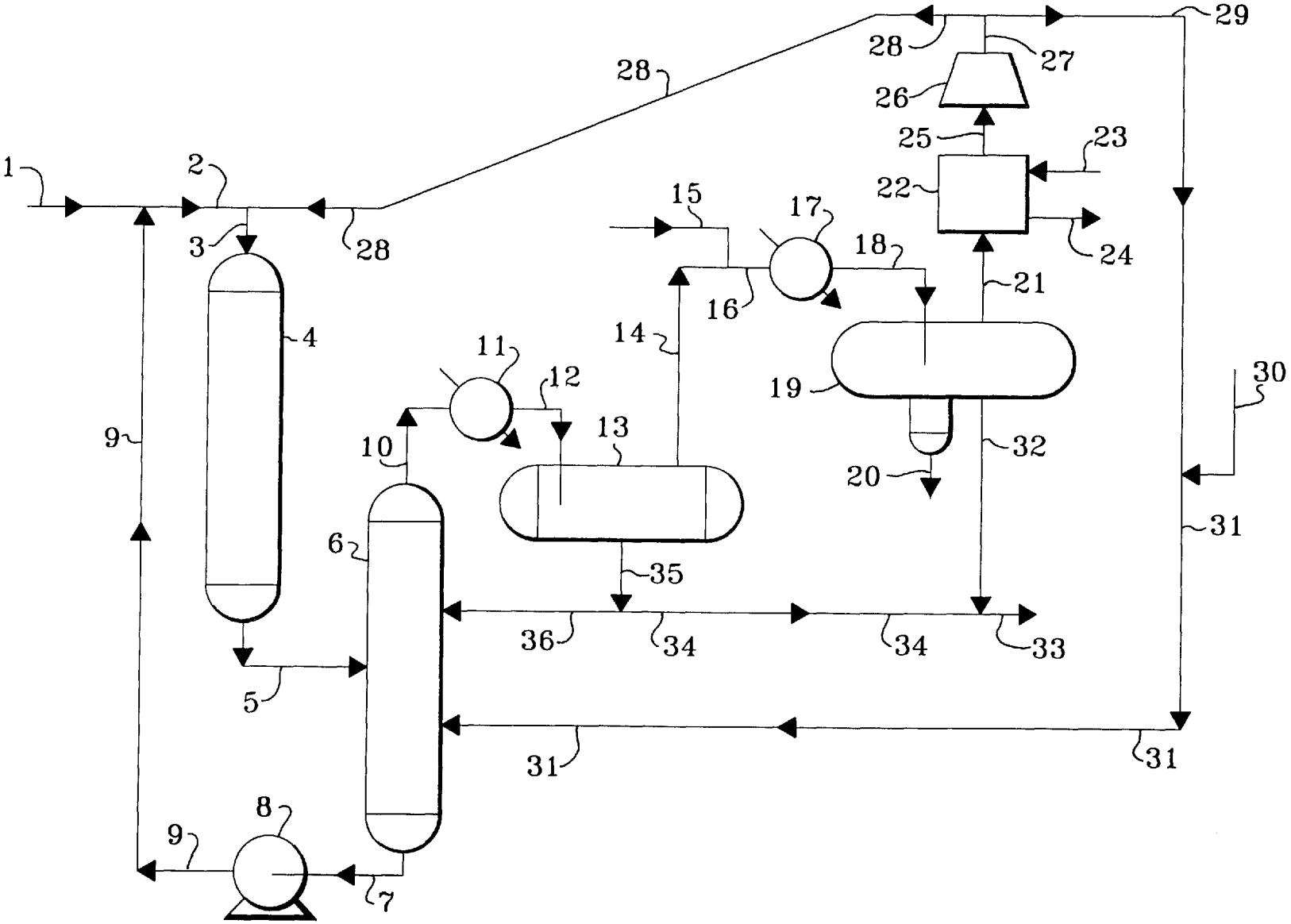
1
2
3
4
5
6
7
8
9
9
10
11
12
13
14
15
16
17
18
19
20
21
22
23
24
25
26
27
28
28
28
29
30
31
31
31
32
33
34
34
35
36

PROCESS FOR HYDROCRACKING A HYDROCARBONACEOUS FEEDSTOCK

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs and higher liquid product yields. It is generally known that enhanced product selectivity can be achieved at lower conversion per pass through the catalytic hydrocracking zone. Low conversion per pass is generally more expensive, however, the present invention greatly improves the economic benefits of a low conversion per pass process.

BRIEF SUMMARY OF THE INVENTION

The present invention is a catalytic hydrocracking process which provides lower costs and higher liquid product yields while reducing the production of undesirable normally gaseous hydrocarbons. The process of the present invention provides the yield advantages associated with a low conversion per pass operation without compromising unit economics. The envisioned high recycle liquid rate will eliminate the need for hydrogen quench, minimize the fresh feed pre-heat since the hot recycle liquid will provide heat, and eliminate the need for diesel fractionation since a diesel product stream can be taken as a bottoms product. An overall reduction in fuel gas consumption is also anticipated. In addition, the low conversion per pass operation requires less catalyst volume.

In accordance with one embodiment of the present invention, a hydrocarbonaceous feedstock and a liquid recycle stream having a temperature greater than about 500° F. and saturated with hydrogen, and a hydrogen-rich gas is contacted with a metal promoted hydrocracking catalyst in a hydrocracking reaction zone at elevated temperature and pressure sufficient to obtain a substantial conversion of the hydrocarbonaceous feedstock to lower boiling hydrocarbons. The resulting hot, uncooled effluent from the hydrocracking reaction zone is hydrogen stripped in a stripping zone maintained at essentially the same pressure as the hydrocracking zone with a first hydrogen-rich gaseous stream to produce a first gaseous hydrocarbonaceous stream and a first liquid hydrocarbonaceous stream. At least a portion of the first gaseous hydrocarbonaceous stream is condensed to produce a second liquid hydrocarbonaceous stream and a second hydrogen-rich gaseous stream. At least a portion of the first liquid hydrocarbonaceous stream is recycled to supply the liquid recycle stream and at least a portion of the second hydrogen-rich gaseous stream is recycled to provide at least a portion of the hydrogen supplied to the hydrocracking reaction zone. At least a portion of the second liquid hydrocarbonaceous stream is recovered and separated to produce desired hydrocarbonaceous product streams.

In accordance with one embodiment of the present invention, a hydrocarbonaceous feedstock, a liquid recycle stream having a temperature greater than about 700° F. and saturated with hydrogen, and a hydrogen-rich gas is contacted with a metal promoted hydrocracking catalyst in a hydrocracking reaction zone at elevated temperature and pressure sufficient to obtain a substantial conversion of the hydrocarbonaceous feedstock to lower boiling hydrocarbons. The resulting hot effluent from the hydrocracking reaction zone is stripped with a hot hydrogen-rich gas stream in a stripping zone maintained at essentially the same pressure as the hydrocracking zone to produce a first gaseous hydrocarbonaceous stream containing hydrocarbonaceous compounds boiling at a temperature less than about 700° F. and a first liquid hydrocarbonaceous stream containing hydrocarbonaceous compounds boiling at a temperature greater than about 700° F. The first gaseous hydrocarbonaceous stream is cooled and partially condensed to produce a second liquid hydrocarbonaceous stream and a second gaseous hydrocarbonaceous stream. The second gaseous hydrocarbonaceous stream is then cooled and partially condensed to produce a third liquid hydrocarbonaceous stream and a second hydrogen-rich gaseous stream. At least a portion of the first liquid hydrocarbonaceous stream is recycled to the hydrocracking reaction zone. At least a portion of the second hydrogen-rich gaseous stream is recycled to the hydrocracking reaction zone and at least another portion is recycled to supply at least a portion of the hydrogen-rich gas which is introduced into the stripping zone. At least a portion of the second liquid hydrocarbonaceous stream is recycled to the stripping zone to provide a reflux to aid the separation of product hydrocarbons from higher boiling hydrocarbon compounds. At least a portion of the second liquid hydrocarbonaceous stream and the third liquid hydrocarbonaceous stream is recovered and separated to produce desired hydrocarbonaceous product streams.

In another embodiment the present invention relates to a process for hydrocracking a hydrocarbonaceous feedstock to produce lower boiling hydrocarbonaceous compounds which process comprises: (a) contacting the hydrocarbonaceous feedstock, a liquid recycle stream having a temperature greater than about 500° F. and saturated with hydrogen, and added hydrogen with a metal promoted hydrocracking catalyst in a hydrocracking zone at elevated temperature and pressure sufficient to obtain a substantial conversion to lower boiling hydrocarbons; (b) stripping the uncooled hydrocarbon effluent from the hydrocracking zone in a stripping zone maintained at essentially the same pressure as the hydrocracking zone with a first hydrogen-rich gaseous stream to produce a first gaseous hydrocarbonaceous stream and a first liquid hydrocarbonaceous stream; (c) condensing at least a portion of the first gaseous hydrocarbonaceous stream and separating the same into a second liquid hydrocarbonaceous stream and a second hydrogen-rich gaseous stream; (d) recycling at least a portion of the first liquid hydrocarbonaceous stream to supply at least a portion of the liquid recycle stream in step (a); (e) recycling at least a portion of the second hydrogen-rich gaseous stream from step (c) to supply at least a portion of the added hydrogen in step (a) and at least a portion of the first hydrogen-rich gaseous stream in step (b); and (f) recovering at least a portion of the second liquid hydrocarbonaceous stream.

Another embodiment of the present invention relates to a process for hydrocracking a hydrocarbonaceous feedstock to produce lower boiling hydrocarbonaceous compounds which process comprises: (a) contacting the hydrocarbonaceous feedstock and a liquid recycle stream having a temperature greater than about 700° F. and saturated with hydrogen, and added hydrogen with a metal promoted hydrocracking catalyst in a hydrocracking zone at elevated temperature and pressure sufficient to obtain a substantial conversion to lower boiling hydrocarbons; (b) stripping the uncooled hydrocarbon effluent from the hydrocracking zone in a stripping zone maintained at essentially the same pressure as the hydrocracking zone with a first hydrogen-rich gaseous stream to produce a first gaseous hydrocarbonaceous stream containing hydrocarbonaceous compounds boiling at a temperature less than about 700° F. and to produce a first liquid hydrocarbonaceous stream containing hydrocarbonaceous compounds boiling at a temperature greater than about 700° F.; (c) condensing at least a portion of the first gaseous hydrocarbonaceous stream and separating the same into a second liquid hydrocarbonaceous stream and a second gaseous hydrocarbonaceous stream; (d) condensing at least a portion of the second gaseous hydrocarbonaceous stream to produce a third liquid hydrocarbonaceous stream and a second hydrogen-rich gaseous stream; (e) recycling at least a portion of the first liquid hydrocarbonaceous steam to supply at least a portion of the liquid recycle stream in step (a); (f) recycling at least a portion of the second hydrogen-rich gaseous stream from step (d) to supply at least a portion of the added hydrogen in step (a) and at least a portion of the first hydrogen-rich gaseous stream in step (b); (g) recycling at least a portion of the second liquid hydrocarbonaceous stream to the stripping zone in step (b); and (h) recovering at least a portion of the second liquid hydrocarbonaceous stream and the third liquid hydrocarbonaceous stream.

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that higher liquid product yields and a lower cost of production can be achieved and enjoyed in the above-described hydrocracking process unit.

The process of the present invention is particularly useful for hydrocracking a hydrocarbon oil containing hydrocarbons and/or other organic materials to produce a product containing hydrocarbons and/or other organic materials of lower average boiling point and lower average molecular weight. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 550° F., such as atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distilllates. A preferred hydrocracking feedstock is a gas oil or other hydrocarbon fraction having at least 50% by weight, and most usually at least 75% by weight, of its components boiling at temperatures above the end point of the desired product, which end point, in the case of heavy gasoline, is generally in the range from about 380° F. to about 420° F. One of the most preferred gas oil feedstocks will contain hydrocarbon components which boil above 550° F. with best results being achieved with feeds containing at least 25 percent by volume of the components boiling between 600° F. and 1000° F.

Also included are petroleum distillates wherein at least 90 percent of the components boil in the range from about 300° F. to about 800° F. The petroleum distillates may be treated to produce both light gasoline fractions (boiling range, for example, from about 50° F. to about 185° F.) and heavy gasoline fractions (boiling range, for example, from about 185° F. to about 400° F.).

The selected feedstock is introduced into a hydrocracking zone. The hydrocracking zone may contain one or more beds of the same or different catalyst. In one embodiment, when the preferred products are middle distillates the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz). The hydrocracking of the hydrocarbonaceous feedstock in contact with a hydrocracking catalyst is conducted in the presence of hydrogen and preferably at hydrocracking conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 10 volume percent of the fresh feedstock.

In one embodiment, after the hydrocarbonaceous feedstock has been subjected to hydrocracking as hereinabove described, the resulting uncooled effluent from the hydrocracking reaction zone is introduced into a stripping zone maintained at essentially the same pressure as said hydrocracking zone and contacted with a hydrogen-rich gaseous stream to produce a first gaseous hydrocarbonaceous stream containing hydrocarbonaceous compounds boiling at a temperature less than about 700° F. and a first liquid hydrocarbonaceous stream containing hydrocarbonaceous compounds boiling at a temperature greater than about 700° F. The stripping zone is preferably maintained at a temperature in the range from about 450° F. to about 875° F. The effluent from the hydrocracking reaction zone is not substantially cooled and would only be lower in temperature due to unavoidable heat loss during transport from the reaction zone to the stripping zone. It is preferred that the cooling of the hydrocracking reaction zone effluent is less than about 50° F. By maintaining the pressure of the stripping zone at essentially the same pressure as the reaction zone is meant that any difference in pressure is due to the pressure drop required to flow the effluent stream from the reaction zone to the stripping zone. It is preferred that the pressure drop is less than about 50 psig. The hydrogen-rich gaseous stream is preferably supplied in an amount greater than about 10 weight percent of the hydrocarbonaceous feedstock. A hereinafter-described liquid hydrocarbonaceous stream is introduced into an upper portion of the stripping zone in an amount of greater than about 1 weight percent of the hydrocarbonaceous feedstock as reflux. The resulting first liquid hydrocarbonaceous stream produced in the stripping zone is recycled to the catalytic hydrocracking reaction zone in an amount of about 50% to about 500% of the fresh feedstock.

The resulting first gaseous hydrocarbonaceous stream containing hydrocarbonaceous compounds characterized by a normal boiling point temperature less than about 700° F. is cooled to a temperature in the range from about 450° F. to about 750° F. to produce a second gaseous hydrocarbonaceous stream and a second liquid hydrocarbonaceous stream at least a portion of which is introduced into an upper portion of the stripper zone in an amount sufficient to serve as reflux. At least another portion of the second liquid hydrocarbonaceous stream is recovered and fractionated to produce desired hydrocarbon product streams.

The resulting second gaseous hydrocarbonaceous stream is preferably cooled to a temperature in the range from about 40° F. to about 140° F. to produce a third liquid hydrocarbonaceous stream which is recovered and fractionated to produce desired hydrocarbon product streams, and to produce a second hydrogen-rich gaseous stream which is bifurcated to provide at least a portion of the added hydrogen introduced into the hydrocracking zone and at least a portion of the first hydrogen-rich gaseous stream introduced into the stripping zone. Fresh make-up hydrogen is preferably introduced into the stripping zone. Before the portion of the second hydrogen-rich gaseous stream is introduced into the hydrocracking zone, it is preferred that at least a significant portion, at least about 90 weight percent for example, of the hydrogen sulfide is removed and recovered by means of known, conventional methods.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil and heavy coker gas oil is introduced into the process via conduit 1 and admixed with a liquid hydrocarbon recycle stream provided via conduit 9 and the resulting admixture is transported via conduit 2 and is joined with a hydrogen-rich gaseous stream provided via conduit 28 and this resulting admixture is introduced via conduit 3 into hydrocracking zone 4. A hydrocracked hydrocarbon stream having components boiling at a temperature less than about 700° F. (371° C.) is recovered from hydrocracking zone 4 via conduit 5 and is introduced into stripping zone 6. A hydrogen-rich gaseous stream is introduced as a stripping gas via conduit 31 into stripping zone 6 to produce a gaseous stream effluent containing hydrocarbonaceous compounds boiling at a temperature less than about 700° F. which is removed via conduit 10 from stripping zone 6 and partially condensed in heat-exchanger 11 and the resulting cooled effluent stream is transported via conduit 12 and introduced into vapor-liquid separator 13. A liquid hydrocarbonaceous stream is removed from vapor-liquid separator 13 via conduit 35 and at least a portion is introduced via conduit 36 into stripping zone 6 to serve as reflux and another portion is recovered via conduits 34 and 33. A liquid hydrocarbonaceous stream containing hydrocarbonaceous compounds boiling at a temperature greater than about 700° F. and saturated with hydrogen is removed from stripping zone 6 via conduit 7, transported via pump 8 and conduit 9 and is recycled to join the fresh feed stream as described hereinabove. A gaseous stream containing hydrogen, hydrocarbonaceous compounds and water soluble inorganic compounds is removed from vapor-liquid separator 13 via conduit 14 and is contacted with an aqueous stream introduced via conduit 15 and the resulting admixture is transported via conduit 16 into heat-exchanger 17. The resulting cooled and partially condensed effluent from heat-exchanger 17 is transported via conduit 18 and introduced into vapor-liquid separator 19. An aqueous stream containing water-soluble salts is removed from vapor-liquid separator 19 via conduit 20 and recovered. A hydrogen-rich gaseous stream is removed from vapor-liquid separator 19 via conduit 21 and is introduced into acid gas recovery zone 22. A lean solvent is introduced via conduit 23 into acid gas recovery zone 22 and contacts the hydrogen-rich gaseous stream in order to dissolve an acid gas. A rich solvent containing acid gas is removed from acid gas recovery zone 22 via conduit 24 and recovered. A hydrogen-rich gaseous stream containing a reduced concentration of acid gas is removed from acid gas recovery zone 22 via conduit 25 and is introduced into compressor 26. A resulting compressed hydrogen-rich gaseous stream is transported via conduit 27 and at least a portion is recycled via conduit 28 to hydrocracking zone 4 as described hereinabove. Another portion of the hydrogen-rich gaseous stream is transported via conduits 27 and 29 and is admixed with a fresh hydrogen make-up stream provided via conduit 30 and the resulting admixture is transported via conduit 31 and is introduced into stripping zone 6.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A portion of a hydrocracker feedstock having the characteristics presented in Table 1 is hydrocracked in a conventional single stage hydrocracker at operating conditions presented in Table 2 to yield the products described in Table 3. Another portion of the same hydrocracker feedstock is hydrocracked in a hydrocracker of the present invention at operating conditions presented in Table 2 to yield the products described in Table 3.

From the tables it is apparent that the present invention utilizes a hydrocracking reactor having 30% less volume as well as 30% less catalyst inventory. Because of the lower reactor operating temperature in the present invention, the conversion per pass is reduced from 65% to 30%. The present invention utilizes a hydrogen to oil recycle ratio of only 8500 SCFB (standard cubic feet per barrel) compared with the conventional single stage hydrocracker which uses a ratio of 10,500 SCFB. These changes used in the present invention promote a lower cost hydrocracking process.

In addition to the hereinabove-described advantages, the present invention achieves an increase of $C_5^+$ yield of about 0.6 weight percent and an increase of about 5 volume percent of combined kerosene and diesel oil. The present invention also has a 30 SCFB lower chemical hydrogen consumption and a 50% less hydrogen loss to fuel gas.

TABLE 1

HYDROCRACKER FEEDSTOCK ANALYSIS
80/20 Blend Straight Run Vacuum Gas Oil-Coker Gas Oil

| | | |
|---|---|---|
| Gravity, ° API | 21 | |
| Distillation, Volume Percent | | |
| IBP, ° F. (° C.) | 664 | (351) |
| 10 | 716 | (379) |
| 30 | 767 | (408) |
| 50 | 817 | (436) |
| 70 | 880 | (471) |
| 90 | 965 | (518) |
| FBP | 1050 | (565) |
| Sulfur, weight percent | 3.01 | |
| Nitrogen, PPM | 1256 | |
| Bromine Number | 7.5 | |
| Heptane Insolubles, weight percent | <0.05 | |
| Conradson Carbon, weight percent | 0.36 | |
| Nickel and Vanadium, PPM | 0.4 | |

TABLE 2

SUMMARY OF OPERATING CONDITIONS

| | BASE CASE | INVENTION |
|---|---|---|
| Flowscheme | Standard Single Stage | Hot, High-Pressure Product Stripper |
| Reactor Operating Conditions | | |
| Hydrogen Pressure, PSIA | 2300 | 2300 |
| Space Velocity | Base | Base × 1.4 |
| Temperature, ° F. | Base | Base-20° F. |
| Conversion Per Pass* | 65% | 30% |
| Recycle Hydrogen to Oil Ratio, SCFB | 10,500 | 8500 |
| Total (Gross) Conversion, %* | 100 | 100 |
| Number of Gas Quench Points | 3 | 0 |
| Maximum Reactor ΔT, ° F. | 50 | 30 |

*Conversion to 700° F. end point distillate and lighter

TABLE 3

| PRODUCT YIELDS | BASE CASE | | INVENTION | |
|---|---|---|---|---|
| | Wt. % | Vol. % | Wt. % | Vol. % |
| $NH_3$ | 0.15 | | 0.15 | |
| $H_2S$ | 3.20 | | 3.20 | |
| $C_1$–$C_4$ | 3.68 | | 3.0 | |
| Light Naphtha ($C_5$–$C_6$) | 6.32 | 8.76 | 5.77 | 8.0 |
| Heavy Naphtha ($C_7$ - 260° F.) | 10.38 | 12.87 | 7.26 | 9.0 |
| Kerosine (260°–550° F.) | 50.16 | 58.15 | 51.75 | 60.0 |
| Diesel (550°–720° F.) | 28.72 | 31.98 | 31.43 | 35.0 |
| $C_5$ + TOTAL | 95.58 | 111.76 | 96.21 | 112.0 |
| Chemical $H_2$ Consumption (SCFB) | 2.61 | 1600 | 2.56 | 1570 |

The foregoing description, drawing and illustrative embodiment clearly illustrate the advantages encompassed by the process of the present invention and the benefits to be afforded with the use thereof.

What is claimed:

1. A process for hydrocracking a hydrocarbonaceous feedstock to produce lower boiling hydrocarbonaceous compounds which process comprises:

(a) contacting said hydrocarbonaceous feedstock, a liquid recycle stream having a temperature greater than about 500° F. and saturated with hydrogen, and added hydrogen with a metal promoted hydrocracking catalyst in a hydrocracking zone at an elevated temperature in the range from about 450° F. (232° C.) to about 875° F. (468° C.) and a pressure in the range from about 500 psig (3448 kPa gauge) to about 3000 psig (20685 kPa gauge) sufficient to obtain a substantial conversion to lower boiling hydrocarbons;

(b) stripping the uncooled hydrocarbon effluent from said hydrocracking zone in a hot, high pressure stripping zone maintained at essentially the same pressure as said hydrocracking zone and a temperature in the range from about 450° F. to about 875° F. with a first hydrogen-rich gaseous stream to produce a first gaseous hydrocarbonaceous stream and a first liquid hydrocarbonaceous stream;

(c) condensing at least a portion of said first gaseous hydrocarbonaceous stream and separating the same into a second liquid hydrocarbonaceous stream and a second hydrogen-rich gaseous stream;

(d) recycling at least a portion of said first liquid hydrocarbonaceous stream to supply at least a portion of said liquid recycle stream in step (a);

(e) recycling at least a portion of said second hydrogen-rich gaseous stream from step (c) to supply at least a portion of said added hydrogen in step (a) and at least a portion of said first hydrogen-rich gaseous stream in step (b); and (f) recovering at least a portion of said second liquid hydrocarbonaceous stream.

2. The process of claim 1 wherein at least a portion of said second liquid hydrocarbonaceous stream is recycled to said stripping zone.

3. The process of claim 1 wherein said metal promoted hydrocracking catalyst comprises synthetic faujasite.

4. The process of claim 1 wherein said metal promoted hydrocracking catalyst comprises a metal selected from Group VIII and Group VIB.

5. The process of claim 1 wherein said hydrocarbonaceous feedstock boils at a temperature greater than about 650° F. (343° C.).

6. The process of claim 1 wherein said first liquid recycle stream is present in an amount from about 50 to about 500 volume percent based on said hydrocarbonaceous feedstock.

7. The process of claim 1 wherein said metal promoted hydrocracking catalyst comprises silica-alumina.

8. The process of claim 1 wherein said first hydrogen-rich gaseous stream is recycled to step (b) at a rate of greater than about 10 weight percent of the hydrocarbonaceous feedstock.

9. The process of claim 2 wherein said second liquid hydrocarbonaceous stream to said stripping zone is supplied at a rate of greater than about 1 weight percent of the hydrocarbonaceous feedstock.

10. A process for hydrocracking a hydrocarbonaceous feedstock to produce lower boiling hydrocarbonaceous compounds which process comprises:

(a) contacting said hydrocarbonaceous feedstock and a liquid recycle stream having a temperature greater than about 700° F. and saturated with hydrogen, and added hydrogen with a metal promoted hydrocracking catalyst in a hydrocracking zone at an elevated temperature in the range from about 450° F. (232° C.) to about 875° F. (468° C.) and a pressure in the range from about 500 psig (3448 kPa gauge) to about 3000 psig (20685 kPa gauge) sufficient to obtain a substantial conversion to lower boiling hydrocarbons;

(b) stripping the uncooled hydrocarbon effluent from said hydrocracking zone in a hot, high pressure stripping zone maintained at essentially the same pressure as said hydrocracking zone and a temperature in the range from about 450° F. to about 875° F. with a first hydrogen-rich gaseous stream to produce a first gaseous hydrocarbonaceous stream containing hydrocarbonaceous compounds boiling at a temperature less than about 700° F. and to produce a first liquid hydrocarbonaceous stream containing hydrocarbonaceous compounds boiling at a temperature greater than about 700° F.;

(c) condensing at least a portion of said first gaseous hydrocarbonaceous stream and separating the same into a second liquid hydrocarbonaceous stream and a second gaseous hydrocarbonaceous stream;

(d) condensing at least a portion of said second gaseous hydrocarbonaceous stream to produce a third liquid hydrocarbonaceous stream and a second hydrogen-rich gaseous stream;

(e) recycling at least a portion of said first liquid hydrocarbonaceous steam to supply at least a portion of said liquid recycle stream in step (a);

(f) recycling at least a portion of said second hydrogen-rich gaseous stream from step (d) to supply at least a portion of said added hydrogen in step (a) and at least a portion of said first hydrogen-rich gaseous stream in step (b);

(g) recycling at least a portion of said second liquid hydrocarbonaceous stream to said stripping zone in step (b); and (h) recovering at least a portion of said second liquid hydrocarbonaceous stream and said third liquid hydrocarbonaceous stream.

11. The process of claim 10 wherein said metal promoted hydrocracking catalyst comprises synthetic faujasite.

12. The process of claim 10 wherein said metal promoted hydrocracking catalyst comprises a metal selected from Group VIII and Group VIB.

13. The process of claim 10 wherein said hydrocarbonaceous feedstock boils at a temperature greater than about 650° F. (343° C.).

14. The process of claim 10 wherein said liquid recycle stream is present in an amount from about 50 to about 500 volume percent based on said hydrocarbonaceous feedstock.

15. The process of claim 10 wherein said metal promoted hydrocracking catalyst comprises silica-alumina.

16. The process of claim 10 wherein said first hydrogen-rich gaseous stream is recycled in step (b) at a rate of greater than about 10 weight percent of the hydrocarbonaceous feedstock.

17. The process of claim 10 wherein said second liquid hydrocarbonaceous stream to said stripping zone is supplied at a rate of greater than about 1 weight percent of the hydrocarbonaceous feedstock.

* * * * *